US005542556A

United States Patent [19]

Ohmi et al.

[11] Patent Number: 5,542,556

[45] Date of Patent: Aug. 6, 1996

[54] PLASTIC CLOSURE WITH STRUCTURAL THREAD FORMATION

[75] Inventors: Hidehiko Ohmi; Tateo Kubo; Tomoya Igarashi, all of Hiratsuka, Japan

[73] Assignee: Japan Crown Cork Co., Ltd., Tokyo, Japan

[21] Appl. No.: 407,607

[22] Filed: Mar. 21, 1995

[30] Foreign Application Priority Data

May 17, 1994 [JP] Japan ..... 6-103026

[51] Int. Cl.[6] ..... B65D 41/04

[52] U.S. Cl. ..... 215/329; 215/252; 215/307; 215/349

[58] Field of Search ..... 215/329, 252, 215/307, 341, 348, 349, 350

[56] References Cited

U.S. PATENT DOCUMENTS

| | | | |
|---|---|---|---|
| 4,369,889 | 1/1983 | Ostrowsky | 215/246 |
| 4,418,828 | 12/1983 | Wilde et al. . | |
| 4,497,765 | 2/1985 | Wilde et al. . | |
| 4,674,643 | 6/1987 | Wilde et al. | 215/252 |
| 4,978,017 | 12/1990 | McBride | 215/252 |
| 5,205,426 | 4/1993 | McBride et al. | 215/252 |
| 5,207,341 | 5/1993 | Yeager | 215/334 |
| 5,257,705 | 11/1993 | de Santana | 215/252 |
| 5,265,747 | 11/1993 | Gregory et al. | 215/349 |
| 5,289,931 | 3/1994 | Doi . | |

FOREIGN PATENT DOCUMENTS

| | | |
|---|---|---|
| 58-51116 | 3/1983 | Japan . |
| 63-44627 | 9/1988 | Japan . |
| 4-311461 | 11/1992 | Japan . |
| 56001 | 2/1968 | Luxembourg . |
| 2034289 | 6/1980 | United Kingdom . |
| WO81/00838 | 4/1981 | WIPO . |

*Primary Examiner*—Stephen K. Cronin
*Attorney, Agent, or Firm*—Beveridge, DeGrandi, Weilacher & Young

[57] ABSTRACT

An internal thread is formed on the inner peripheral surface of a skirt wall in a container closure of a plastic. The cross-sectional shape of the internal thread is defined by an upper side edge extending radially inwardly in an axially downwardly inclined manner, a lower side edge extending radially inwardly in an axially upwardly inclined manner, a front edge extending substantially vertically, two concave arcs, and two convex arcs.

5 Claims, 2 Drawing Sheets

PLASTIC CLOSURE WITH STRUCTURAL THREAD FORMATION

FIELD OF THE INVENTION

This invention relates to a container closure of a plastic for application to the mouth-neck portion of glass or plastic containers for soft drinks.

DESCRIPTION OF THE PRIOR ART

Containers for soft drinks have a cylindrical mouth-neck portion, on whose outer peripheral surface is formed an external thread. Container closures of plastics have recently found wide use for such containers. Such a plastic container closure has a top panel wall, and a cylindrical skirt wall extending downwardly from the peripheral edge of the top panel wall. On the inner peripheral surface of the skirt wall is formed an internal thread to be engaged with the external thread of the mouth-neck portion.

The above-mentioned plastic container closure is formed from a plastic, such as polypropylene or polyethylene, by compression molding or injection molding. The internal thread formed on the inner peripheral surface of the skirt wall produces a so-called undercut. When the container closure molded is to be removed from the mold, so-called forced stripping is performed. Owing to this forced stripping concerned with the internal thread, the conventional plastic container closure tends to bring about the following problems:

(1) A so-called internal thread droop, the phenomenon that the internal thread of the container closure molded is caused to incline downwardly compared with its shape as molded;

(2) A so-called thready bulge of the skirt wall, the phenomenon that a thready projection is formed on the outer peripheral surface of the skirt wall correspondingly to the position of the internal thread formed on the inner peripheral surface of the skirt wall; and (3) Skirt wall buckling, the phenomenon that if a relatively thin-walled tamper-evident bottom portion is disposed in a part of the skirt wall, especially, a lower part of the skirt wall, the skirt wall is caused to buckle at the tamper-evident bottom portion.

To solve these problems, it is attempted to avoid forced stripping by using a mold including a so-called split portion which is caused to contract radially, or a mold including a so-called turn-release portion which is withdrawn from inside the container along the internal thread. The use of the mold with the split portion, or the mold with the turn-release portion, however, makes the mold itself expensive and considerably lowers the efficiency of molding the container closure.

Furthermore, a liner member is usually disposed on the top panel wall of the container closure. The liner member is advantageously formed by feeding a softened molten plastic material inside the top panel wall, and then inserting an embossing tool into the container closure to press the plastic material. In this case, Japanese Patent Publication No. 44627/88, for example, discloses forming an annular protrusion at an upper end portion of the inner peripheral surface of the skirt wall, and molding the liner member, while contacting the front end of the embossing tool with the annular protrusion to prevent the plastic material compressed from flowing along the skirt wall beyond the annular protrusion. According to our experience, however, since the annular protrusion produces an undercut, forced stripping is carried out against the annular protrusion when the container closure is released from the mold. As a result, a front end portion of the annular protrusion is somewhat deformed to a wavy shape. Owing to this wavy deformation, flowing of the compressed plastic material beyond the annular protrusion cannot be prevented fully reliably even when the front end portion of the embossing tool is contacted with the annular protrusion. Thus, it is not rare for an undesirable outflow of the plastic material to occur. Our studies have shown that the following method is desirable for preventing the undesirable outflow of the plastic material fully reliably, i.e., a method which comprises forming a downwardly facing annular shoulder surface at an upper end portion of the inner peripheral surface of the skirt wall; making the inner peripheral surface above the annular shoulder surface extend substantially vertically; intimately contacting the front end of an embossing tool with the annular shoulder surface, or the outer peripheral surface of the embossing tool with the inner peripheral surface above the annular shoulder surface, in forming the liner member; thereby intimately contacting the outer peripheral surface of the resulting liner member with the inner peripheral surface of the skirt wall above the annular shoulder surface, and preventing the compressed plastic material from flowing along the inner peripheral surface of the skirt wall beyond the annular shoulder surface. Even if it is attempted to actualize this desire in the conventional container closure, however, the outside diameter of the embossing tool, which advances into the container closure and whose front end is intimately contacted with the annular shoulder surface or whose outer peripheral surface is intimately contacted with the inner peripheral surface of the skirt wall above the annular shoulder surface, is restricted to substantially the same value as, or a smaller value than, the diameter of the front end of the internal thread defined by the front end of the internal thread formed on the inner peripheral surface of the skirt wall below the annular shoulder surface. Thus, the inside diameter of the inner peripheral surface of the skirt wall above the annular shoulder surface is restricted to substantially the same value as, or a smaller value than, the diameter of the front end of the internal thread. Owing to this restriction, the outside diameter of the resulting liner member molded is limited to a considerably smaller value than a desired outside diameter desired from the viewpoint of sealing of the mouth-neck portion.

SUMMARY OF THE INVENTION

A principal object of this invention is to provide a container closure of a plastic which, although being removed from the mold by forced stripping in conjunction with the internal thread, fully suppresses the aforementioned internal thread droop, thready bulge, and skirt wall buckling.

Another object of the invention is to provide a container closure of a plastic of a type in which a downwardly facing annular shoulder surface is formed at the upper end portion of the inner peripheral surface of the skirt wall, and the inner peripheral surface of the skirt wall above the annular shoulder surface extends substantially vertically, wherein even when a plastic material in a softened molten state is fed to the inner surface of the top panel wall, and an embossing tool is inserted into the container closure to compress the plastic material and form a liner member, the outside diameter of the embossing tool, which has been inserted into the container closure and whose front end is intimately contacted with the annular shoulder surface or whose outer peripheral surface is intimately contacted with the inner peripheral surface of the skirt wall above the annular shoulder surface, can be set at a sufficiently large value, and thus the outside diameter of the liner member can be set at a sufficiently large value.

We have extensively studied the shapes and functions of plastic container closures, especially, the shape and functions of the internal thread formed on the inner peripheral surface of the skirt wall. These studies have led us to find in connection with the essential function of the internal thread in the container closure that a front end portion of an ordinary internal thread nearly semicircular in cross section has no actions, and therefore, the front end portion of the internal thread can be omitted without causing any problems to the essential function of the internal thread in the container closure; and that the above-described principal object can be attained by omitting the front end portion of the internal thread and making the cross section of the internal thread into a characteristic shape.

In order to attain the aforesaid principal object in the light of our new findings, the present invention defines the cross-sectional shape of the internal thread formed on the inner peripheral surface of the skirt wall by an upper side edge extending radially inwardly in an axially downwardly inclined manner, a lower side edge extending radially inwardly in an axially upwardly inclined manner, a flat front edge extending substantially vertically, a concave arc smoothly connecting the inner peripheral surface of the skirt wall to the upper side edge, a concave arc smoothly connecting the inner peripheral surface of the skirt wall to the lower side edge, a convex arc smoothly connecting the upper side edge to the front edge, and a convex arc smoothly connecting the lower side edge to the front edge.

That is, the present invention provides, as a container closure of a plastic achieving the principal object, a container closure of a plastic having a top panel wall and a cylindrical skirt wall extending downwardly from the top panel wall, the skirt wall having an internal thread formed on its inner peripheral surface, wherein the cross-sectional shape of the internal thread is defined by an upper side edge extending radially inwardly in an axially downwardly inclined manner, a lower side edge extending radially inwardly in an axially upwardly inclined manner, a flat front edge extending substantially vertically, a concave arc smoothly connecting the inner peripheral surface of the skirt wall to the upper side edge, a concave arc smoothly connecting the inner peripheral surface of the skirt wall to the lower side edge, a convex arc smoothly connecting the upper side edge to the front edge, and a convex arc smoothly connecting the lower side edge to the front edge.

The width of the front end surface of the internal thread, W, defined by the distance between the intersection of the extension of the upper side edge and the extension of the front edge and the intersection of the extension of the lower side edge and the extension of the front edge is preferably 0.8 to 1.4 mm, particularly, 0.9 to 1.3 mm. The height of the internal thread, H, defined by the distance between the inner peripheral surface of the skirt wall and the front edge is preferably 0.6 to 0.9 mm, particularly, 0.7 to 0.8 mm. It is preferred that the upper side edge extends downwardly inclinedly at an angle of inclination, $\alpha$, of 15 to 35 degrees to the horizon, while the lower side edge extends upwardly inclinedly at an angle of inclination, $\beta$, of 15 to 35 degrees to the horizon.

In order to attain the other object, it is advantageous that a downwardly facing annular shoulder surface is formed at an upper end portion of the inner peripheral surface of the skirt wall, the internal thread is formed below the annular shoulder surface, the inner peripheral surface above the annular shoulder surface extends substantially vertically, the inside diameter of the inner peripheral surface above the annular shoulder surface is made smaller than the inside diameter of the inner peripheral surface below the annular shoulder surface, and is made substantially the same as, or slightly smaller than, the diameter of the front end of the internal thread defined by the front edge of the internal thread. On the inner surface of the top panel wall is disposed a liner member formed by feeding a plastic material on the inner surface of the top panel wall and compressing the plastic material. Advantageously, the outer peripheral surface of the liner member is intimately contacted with the inner peripheral surface of the skirt wall above the annular shoulder surface.

In the plastic container closure of the present invention, the cross-sectional shape of the internal thread formed on the inner peripheral surface of the skirt wall is of a characteristic type such that the front end portion in the conventional internal thread is omitted, and the corners of the cross section are made gentle by arcuate connections of the constituents of the cross section. Thus, the degree of forced stripping concerned with the internal thread is markedly lowered. Despite the removal of the container closure from the mold by forced stripping in conjunction with the internal thread, therefore, the aforementioned internal thread droop, thready bulge, and skirt wall buckling is fully suppressed. By imparting a characteristic shape to the cross section of the internal thread, no problems will arise in the essential function of the internal thread. Furthermore, the front edge of the internal thread is displaced radially outwardly of the front edge of the conventional internal thread. Hence, the outside diameter of the embossing tool to be inserted into the container closure for the molding of the liner member can be made larger than in conventional cases, and so the outside diameter of the liner member can be made greater than in conventional cases.

DETAILED DESCRIPTION OF THE PREFERRED EMBODIMENTS

Preferred embodiments of a container closure of a plastic in accordance with the present invention will be described in detail with reference to the accompanying drawings.

Figure 1:
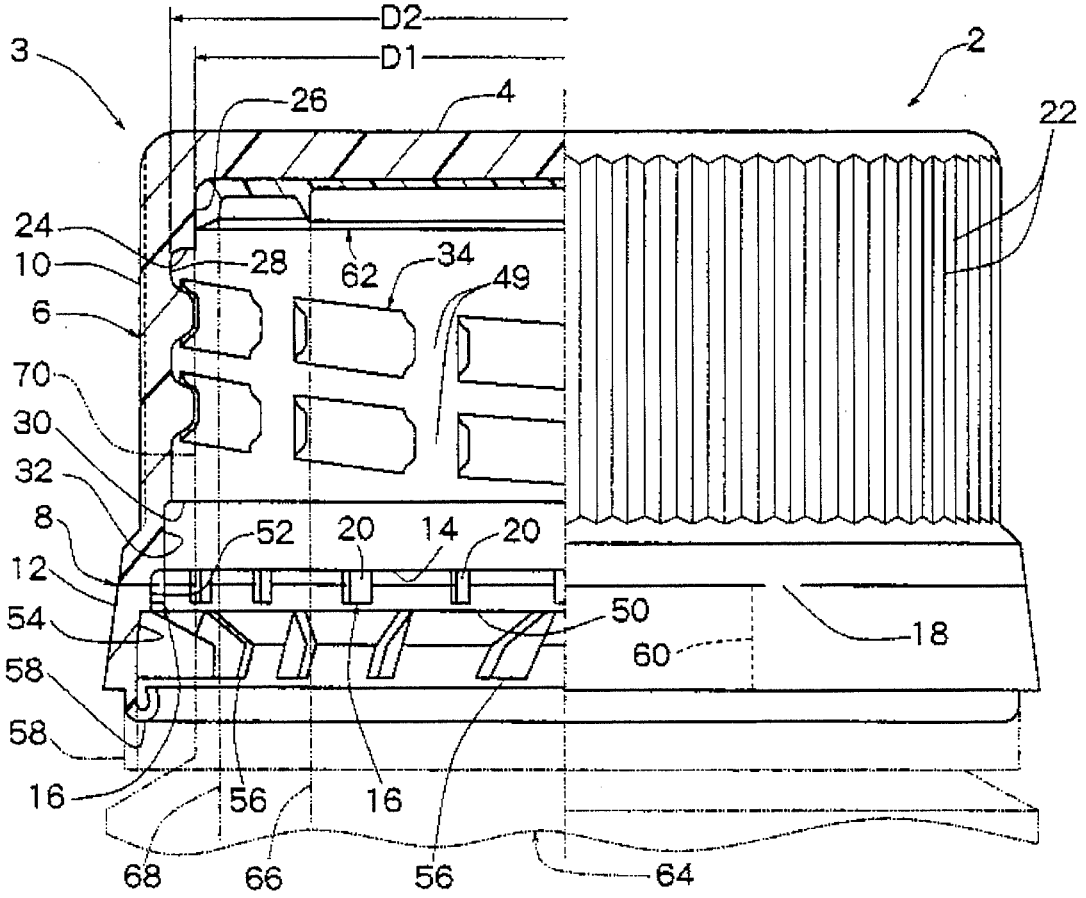
FIG. 1 is a cross-sectional/side view showing, partly in cross section and partly in side elevation, a preferred embodiment of the container closure constituted in accordance with the present invention.

FIG. 1 illustrates a preferred embodiment of a container closure constituted in accordance with the present invention. A container closure generally shown at 2 includes a body 3 optionally formed of a suitable plastic such as polypropylene or polyethylene. This body 3 includes a circular top panel wall 4 and a cylindrical skirt wall 6 extending downwardly from the peripheral edge of the top panel wall 4. In the skirt wall 6 is formed a circumferential breakable line 8 extending in the circumferential direction. The skirt wall 6 is thus divided into a main portion 10 above the circumferential breakable line 8, and a tamper-evident bottom portion 12 below the circumferential breakable line 8. Further details of the circumferential breakable line 8 will follow. An annular shoulder surface 14 facing downward is formed at a lower portion of the skirt wall 6. The inside diameter of the skirt wall 6 below the annular shoulder surface 14 is set to be somewhat larger than the inside diameter of the skirt wall 6 above the annular shoulder surface 14. Immediately below the annular shoulder surface 14 are formed a plurality of axially extending ribs 16 at circumferentially spaced locations on the inner peripheral surface of the skirt wall 6. The circumferential breakable line 8 is formed by cutting the skirt wall 6, with the radially inward portion of the ribs 16 being left behind, by means of a cutting blade applied from the outer peripheral surface of the skirt wall 6. The cutting of the skirt wall 6 does not cover the entire circumferential dimension, but is performed with part of the circumferential dimension remaining intact. The portion left uncut constitutes a non-breakable bridging portion 18, and those portions of the ribs 16 left unbroken constitute ordinary bridging portions 20. The tamper-evident bottom portion 12 below the circumferential breakable line 8 is connected to the main portion 10 via the bridging portions 20 and the non-breakable bridging portion 18.

On the outer peripheral surface of the main portion 10 of the skirt wall 6 are formed a multiplicity of axially extending projections 22 at circumferentially spaced locations. To prevent the slippage of the fingers to be engaged with them, the lower end of each projection 22 is situated somewhat above the lower end of the main portion 10. Beneath the projections 22, the outer peripheral surface of the skirt wall 6 extends inclinedly at a relatively large angle of inclination in a downward and radially outward direction, and then further extends inclinedly at a relatively small angle of inclination in a downward and radially outward direction. With further reference to FIG. 1, an annular shoulder surface 24 facing downward is formed at an upper end portion of the inner peripheral surface of the main portion 10 of the skirt wall 6. The inside diameter, D1, of the inner peripheral surface above the annular shoulder surface 24, i.e., an upper inner peripheral surface 26, is set to be smaller than the inside diameter, D2, of the inner peripheral surface below the annular shoulder surface 24, i.e., an intermediate inner peripheral surface 28. The upper inner peripheral surface 26 is made to extend substantially vertically, and its upper end is connected smoothly to the inner surface of the top panel wall 4 via an arc. Also at a lower end portion of the inner peripheral surface of the main portion 10 of the skirt wall 6 is formed an annular shoulder surface 30 facing downward. The inside diameter of the inner peripheral surface below the annular shoulder surface 30, i.e., a lower inner peripheral surface 32, is set to be larger than the inside diameter D2 of the intermediate inner peripheral surface 28. The intermediate inner peripheral surface 28 and the lower inner peripheral surface 32 are also made to extend substantially vertically.

Figure 2:
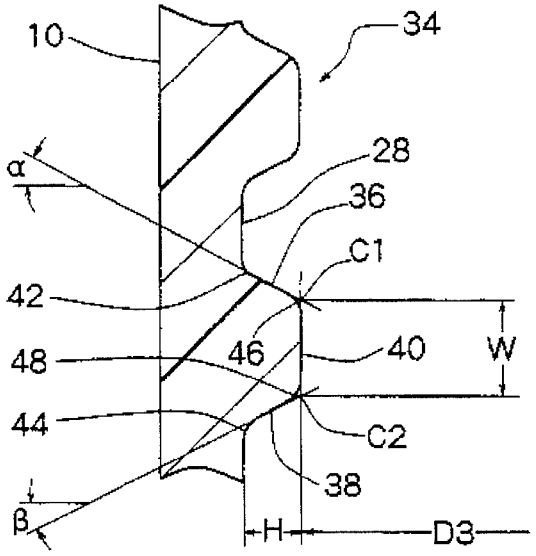
FIG. 2 is an enlarged partial cross sectional view showing the internal thread formed on the inner peripheral surface of the skirt wall in the container closure of FIG. 1.

On the intermediate inner peripheral surface 28 in the main portion 10 of the skirt wall 6 is formed an internal thread 34. With reference to FIG. 2 along with FIG. 1, it is important that the cross-sectional shape of the main portion of the internal thread 34 (namely, the portion excluding the starting end and the terminating end of the internal thread) be a characteristic one defined by an upper side edge 36 extending radially inwardly in an axially downwardly inclined manner, a lower side edge 38 extending radially inwardly in an axially upwardly inclined manner, a flat front edge 40 extending substantially vertically, a concave arc 42 smoothly connecting the intermediate inner peripheral surface 28 to the upper side edge 36, a concave arc 44 smoothly connecting the intermediate inner peripheral surface 28 to the lower side edge 38, a convex arc 46 smoothly connecting the upper side edge 36 to the front edge 40, and a convex arc 48 smoothly connecting the lower side edge 38 to the front edge 40. The width of the front end surface of the internal thread, W, defined by the distance between the intersection C1 of the extension of the upper side edge 36 and the extension of the front edge 40 and the intersection C2 of the extension of the lower side edge 38 and the extension of the front edge 40 is preferably 0.8 to 1.4 mm, particularly, 0.9 to 1.3 mm. The height of the internal thread, H, defined by the distance between the intermediate inner peripheral surface 28 and the front edge 40 is preferably 0.6 to 0.9 mm, particularly, 0.7 to 0.8 mm. If the width W of the front end surface of the internal thread is too small, considerable play will occur in the engagement between the internal thread and the external thread of the mouth-neck portion of a container to be described later, and the strength of the internal thread 34 itself will become too low. If the height H of the internal thread is too large, the undercut associated with the internal thread 34 will become conspicuous, thus causing excessive forced stripping when the body 2 is removed from the mold. This will result in the insufficient suppression of the aforementioned internal thread droop, thready bulge, and skirt wall buckling. If the width W of the front end surface of the internal thread is too large, or the height H of the internal thread too small, on the other hand, the essential function of the internal thread in the container closure tends to become questionable. The angle of inclination, $\alpha$, that the upper side edge 36 forms with the horizon, and the angle of inclination, $\beta$, that the lower side edge 38 forms with the horizon are each preferably about 15 to 35 degrees. If the angle of inclination, $\alpha$, is too small, the undercut associated with the internal thread 34 will become too great. Thus, forced stripping performed when the body 2 is removed from the mold will become excessive. This will result in the insufficient avoidance of the aforementioned internal thread droop, thready bulge, and skirt wall buckling. If the angle of inclination, $\beta$, is too small, one will be unable to smoothly carry out an operation for engaging the internal thread 34 with the external thread formed on the mouth-neck portion of the container to be described later. If the angles of inclination, $\alpha$ and $\beta$, are too large, the essential function of the internal thread in the container closure tends to become questionable. The radii of the concave arcs 42 and 44 and those of the convex arcs 46 and 48 may each be 0.2 to 0.7 mm. The diameter of the front end of the internal thread, D3, defined by the front edge 40 of the internal thread 34 is set to be substantially the same as, or slightly larger than, the inside diameter D1 of the upper inner peripheral surface 26 in the main portion 10 of the skirt wall 6. Advantageously, the internal thread 34 is interrupted at a plurality of sites spaced in the circumferential direction, with axially extending venting passages 49 formed there.

With further reference to FIG. 1, an annular shoulder surface 50 facing downward is formed also at the tamper-evident bottom portion 12. The inside diameter of an inner peripheral surface 52 above the annular shoulder surface 50 is set to be smaller than an inner peripheral surface 54 below the annular shoulder surface 50. On the inner peripheral surface 54 below the annular shoulder surface 50 in the tamper-evident bottom portion 12 are formed a plurality of engaging flap pieces 56 at spaced locations in the circumferential direction. Each of the engaging flap pieces 56 extends, beginning with its base edge connected to the inner peripheral surface 54, radially inwardly in an inclined manner in a direction opposite to the closing direction of the container closure 2 (the clockwise direction as viewed from above in FIG. 1) in which it is rotated when mounted on the mouth-neck portion of the container in the manner to be described later. The base edge of each engaging flap piece 56 also extends, beginning with its upper end connected to the annular shoulder surface 50, axially downwardly in an inclined manner in a direction opposite to that closing direction in which the container closure is rotated. At the lower end of the tamper-evident bottom portion 12 is disposed a thin-walled curl 58. The thin-walled curl 58 is advantageously formed by molding the material into a shape extending substantially vertically downwardly, as shown by a two-dot chain line in FIG. 1, and then shaping the molded material into a curl, as illustrated by the solid line, by means of a heated curling tool (in this connection, reference is requested to Japanese Laid-Open Patent Publication No. 311461/92). On the tamper-evident bottom portion 12 is further formed an axial breakable line 60 extending downwardly from its upper end close to one end of the non-breakable bridging portion 18 in the circumferential breakable line 8. Advantageously, the axial breakable line 60 may be composed of a so-called score formed by cutting the tamper-evident bottom portion 12, at its predetermined angular position, partly, rather than entirely, in its thickness direction from its outer or inner peripheral surface during the cutting step for forming the circumferential breakable line 8.

The body 3 described above can be formed by a manufacturing procedure known per se. A brief mention of the manufacturing procedure will be made hereinbelow. First, the body 3, for which the cutting for defining the circumferential breakable line 8 and the axial breakable line 60 has not been done, and in which the thin-walled curl 5 extends straight downward as shown by the two-dot chain line, is formed by compression molding or injection molding of a suitable plastic material such as polypropylene or polyethylene. On this occasion, the internal thread 34 formed on the intermediate inner peripheral surface 28 in the main portion 10 of the skirt wall 6 generates an undercut. Thus, forced stripping is carried out because of the internal thread 34 when the body 3 is removed from the mold. However, the internal thread 34 is of a characteristic shape as has been described, and the height H of the internal thread, in particular, is set to be smaller than that of an ordinary internal thread. Hence, the degree of forced stripping ascribed to the internal thread 34 is relatively low, thus fully avoiding or suppressing the aforementioned internal thread droop, thready bulge, and skirt wall buckling associated with forced stripping. The manner of compression molding or injection molding for the body 3 may itself be a known one such as described in detail in Japanese Laid-Open Patent Publication No. 51116/83. Hence, a detailed description for it has been or will be omitted in the instant specification. After the body 3 of the described shape has been molded, a cutting step is performed to form the circumferential breakable line 8 and the axial breakable line 60. Subsequent or prior to the cutting step, a curling step is performed to form the thin-walled curl 58.

FIG. 1 will be referred to for further explanation. In the illustrated embodiment, a liner molding step is further performed to form a liner member 62 on the inner surface of the top panel wall 4 of the body 3. The liner member 62 is circular as a whole, and has a thin-walled central portion and a relatively thick-walled peripheral edge portion, the peripheral edge portion having two concentric protrusions protruding downwardly. Such liner member 62 can advantageously be formed by feeding a softened molten plastic material onto the inner surface of the top panel wall 4 of the body 3 held in an inverted state (the state of FIG. 1 turned upside down), and then, as illustrated by a two-dot chain line, inserting an embossing tool 64 into the body 2, followed by advancing it to the illustrated position to compress the plastic material. The embossing tool 64 is composed of a cylindrical center punch member 66, a cylindrical intermediate bushing 68, and a cylindrical outside sleeve 70. As clearly illustrated in FIG. 1, the outer peripheral surface of the front end portion of the outside sleeve 70 is intimately contacted with the upper inner peripheral surface 26 above the annular shoulder surface 24 in the skirt wall 6 of the body 3. Thus, the flowing of the plastic material along the upper inner peripheral surface 26 is restricted. The outer peripheral surface of the liner member embossing tool 64 is intimately contacted with the upper inner peripheral surface 26. In the container closure constituted in accordance with the present invention, the internal thread height H of the internal thread 34 formed on the intermediate inner peripheral surface 28 below the annular shoulder surface 24 in the skirt wall 6 of the body 3 is set to be relatively small. The internal thread front end diameter D3 defined by the front edge 40 of the internal thread 34 is made substantially the same as, or slightly greater than, the inside diameter D1 of the upper inner peripheral surface 26. Therefore, it is possible to insert the embossing tool 64 into the body 3, and bring the outer peripheral surface of the outside sleeve 70 having a relatively large outside diameter into intimate contact with the upper inner peripheral surface 26, without receiving interference from the internal thread 34, thereby molding, with full satisfaction, the liner member 62 having a relatively large outside diameter as required. If desired, it is also possible to set the inside diameter D1 of the upper inner peripheral surface 26 at a value somewhat smaller than the internal thread front end diameter D3, and make the outside diameter of the outside sleeve 70 of the embossing tool 64 slightly larger than the inside diameter D1 of the upper inner peripheral surface 26, thus intimately contacting the front end surface of the outside sleeve 70 with the annular shoulder surface 24 at the time of compressing the liner member 62. In this case, the lower end of the outer peripheral surface of the liner member 62 molded is aligned with the annular shoulder surface 24. A plastic material advantageously usable for the formation of the liner member 62 is a relatively flexible plastic such as flexible polyethylene or EVC (ethylene-vinyl acetate copolymer).

Figure 3:
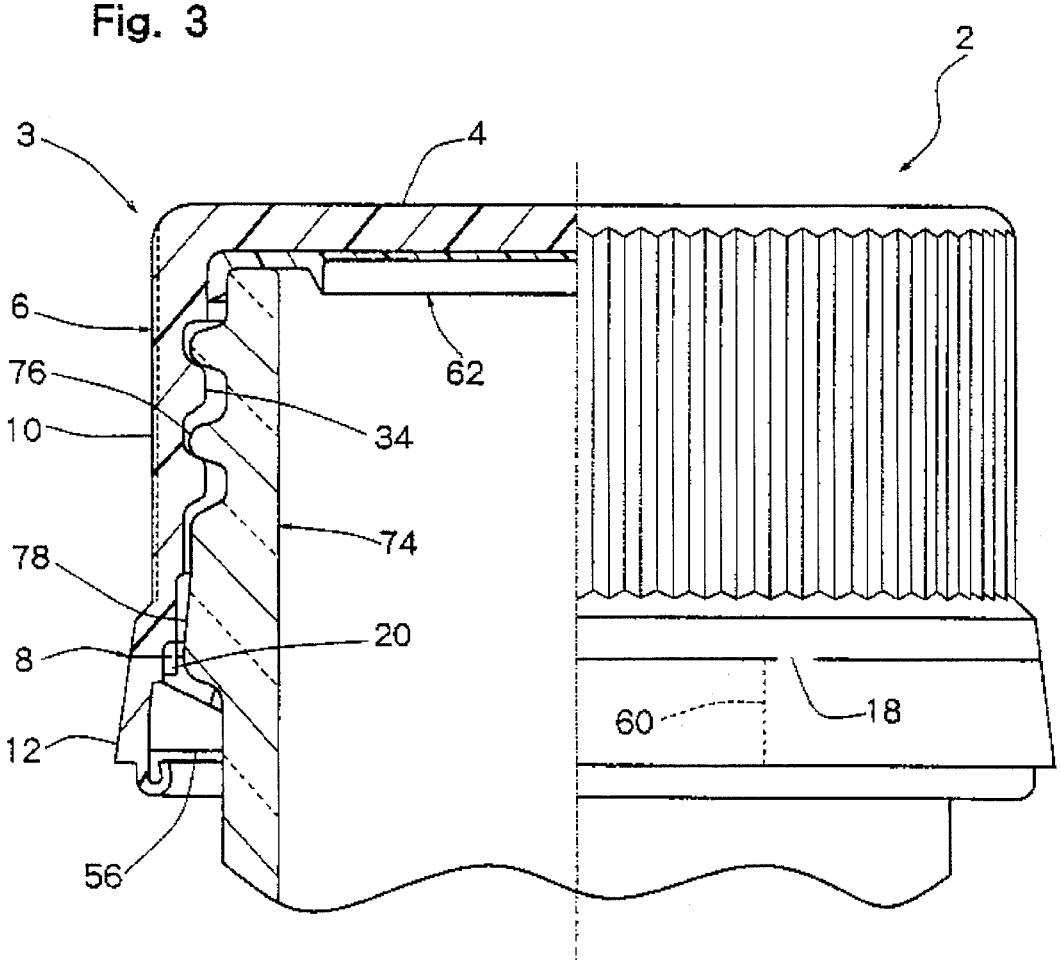
FIG. 3 is a cross-sectional/side view showing, partly in cross section and partly in side elevation, a state in which the container closure of FIG. 1 is mounted on the mouth-neck portion of a container to seal it.

FIG. 3 shows a state in which the container closure 2 comprising the body 3 and the liner member 62 has been mounted on the mouth-neck portion 74 of a container. The container mouth-neck portion 74 known per se and optionally formed of glass or a suitable plastic material such as polyethylene terephthalate is cylindrical as a whole. On its outer peripheral surface an external thread 76 is formed, and an annular engaging jaw portion 78 is located below it. The external thread 76 takes an ordinary form, and its cross section is nearly semicircular. After a required material such as a soft drink is filled into the container, the container closure 2 is mounted on the mouth-neck portion 74 to seal it. To mount the container closure 2 on the mouth-neck portion 74, the container closure 2 is put over the mouth-neck portion 74, and turned in a closing direction, that is, clockwise as viewed from above in FIG. 3. As a result, the internal thread 34 formed in the body 3 of the container closure 2 is engaged with the external thread 76 formed in the mouth-neck portion 74 of the container. The internal thread 34 formed in the body 3 of the container closure 2, as has been stated earlier, has a characteristic cross-sectional shape with the relatively small internal thread height H. As will be understood clearly by reference to FIG. 3, however, the cooperation between the external thread 76 and the internal thread 34 is achieved fully satisfactorily as in conventional cases, without any problems occurring. Each of the engaging flap pieces 56 formed on the inner peripheral surface of the tamper-evident bottom portion 12 in the body 3 of the container closure 2 is elastically deformed upward under interference by the annular engaging jaw portion 78 formed in the mouth-neck portion 74. After passing over the annular engaging jaw portion 78, the engaging flap pieces 56 are elastically restored to their original form to come into engagement with the underside of the annular engaging jaw portion 78. The liner member 62 of the container closure 2 is intimately contacted with the upper end surface of the mouth-neck portion 74 to seal it.

To open the mouth-neck portion 74 of the container, the container closure 2 is turned in an opening direction, that is, counterclockwise as viewed from above in FIG. 3. By so doing, the internal thread 34 formed in the body 3 of the container closure 2 is moved along the external thread 76 formed in the mouth-neck portion 74. Thus, the container closure 2 is moved upward according to it rotation. The tamper-evident bottom portion 12 in the body 3 of the container closure 2 is kept from moving upward, since the engaging flap pieces 56 formed on its inner peripheral surface are engaged with the underside of the annular engaging jaw portion 78 of the mouth-neck portion 74. Consequently, a considerable stress is exerted on the bridging portions 20 in the circumferential breakable line 8 formed in the skirt wall 6 of the body 3, and the bridging portions 20 are broken, leaving the non-breakable bridging portion 18 intact. A considerable stress is also exerted on the axial breakable line 60 formed in the tamper-evident bottom portion 12 to break the axial breakable line 60. These breakages convert the tamper-evident bottom portion 12 from the endless annular form into a tape form. As a result, the engagement of the engaging flap pieces 56 with the annular engaging jaw portion 78 of the mouth-neck portion 74 is released. Thereafter, the entire container closure 2 including the tamper-evident bottom portion 12 connected to the main portion 10 of the skirt wall 6 via the non-breakable bridging portion 18 becomes free to move upward. When the container closure 2 is moved upward to some extent, the liner member 62 is caused to leave the upper end surface of the mouth-neck portion 74, and the inside of the container is allowed to communicate with the outside through the gap between the upper end surface of the mouth-neck portion 74 and the liner member 62 as well as the venting passages 49 formed in the internal thread 34. Thus, the entire container closure 2 is removed from the mouth-neck portion 74 to open it completely.

According to the container closure of the present invention, the degree of forced stripping concerned with the internal thread is markedly reduced without deteriorating the functions of the internal thread. Furthermore, the internal thread droop, thready bulge, and skirt wall buckling ascribed to excessive forced stripping are fully suppressed. In molding the liner member, moreover, an embossing tool having a relatively large outside diameter can be inserted into the body of the container closure without undergoing interference from the internal thread. Thus, the liner member having a sufficiently large outside diameter can be molded as required.

While the present invention has been described in detail hereinabove on the basis of its preferred embodiments with reference to the accompanying drawings, it should be understood that the invention is net limited to these embodiments, but various changes and modifications are possible without departing from the scope of the invention.

What we claim is:

1. A plastic container closure having a top panel wall and a cylindrical skirt wall extending downwardly from the top panel wall, the skirt wall having an internal thread formed on its inner peripheral surface, wherein a cross-sectional shape of the internal thread is defined by an upper side edge extending radially inwardly in an axially downwardly inclined manner, a lower side edge extending radially inwardly in an axially upwardly inclined manner, a flat front edge extending substantially vertically, a concave arc smoothly connecting the inner peripheral surface of the skirt wall to the upper side edge, a concave arc smoothly connecting the inner peripheral surface of the skirt wall to the lower side edge, a convex arc smoothly connecting the upper side edge to the front edge, and a convex arc smoothly connecting the lower side edge to the front edge, wherein a width of a front end surface of the internal thread, defined by the distance between the intersection of an extension of the upper side edge and an extension of the front edge and the intersection of an extension of the lower side edge and the extension of the front edge, is 0.9 to 1.3 mm, and a height of the internal thread, defined by a distance between the inner peripheral surface of the skirt wall and the front edge, is 0.7 to 0.8 mm.

2. The container closure of claim 1, wherein the upper side edge extends downwardly inclinedly at an angle of inclination in the range of 15 to 35 degrees to the horizon, and the lower side edge extends upwardly inclinedly at an angle of inclination in the range of 15 to 35 degrees to the horizon.

3. The container closure of claim 1, wherein a downwardly facing annular shoulder surface is formed at an upper end portion of the inner peripheral surface of the skirt wall, wherein the internal thread is formed below the annular shoulder surface, wherein the inner peripheral surface above the annular shoulder surface extends substantially vertically, wherein an inside diameter of the inner peripheral surface above the annular shoulder surface is smaller than an inside diameter of the inner peripheral surface below the annular shoulder surface, and wherein the inside diameter of the inner peripheral surface above the annular shoulder surface is substantially the same as or slightly smaller than a diameter of the front end of the internal thread defined by the front edge of the internal thread.

4. The container closure of claim 3, wherein a liner member is disposed on an inner surface of the top panel wall, and an outer peripheral surface of the liner member is contacted with the inner peripheral surface of the skirt wall above the annular shoulder surface.

5. The container closure of claim 4, wherein the liner member is formed by feeding a plastic material on the inner surface of the top panel wall and compressing the plastic material.

* * * * *